US007504603B2

(12) United States Patent
Lung

(10) Patent No.: US 7,504,603 B2
(45) Date of Patent: Mar. 17, 2009

(54) SHEET AND SHEET SWITCH

(75) Inventor: Ssu-Min Lung, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 63 days.

(21) Appl. No.: 11/656,083

(22) Filed: Jan. 22, 2007

(65) Prior Publication Data

US 2007/0170645 A1 Jul. 26, 2007

(30) Foreign Application Priority Data

Jan. 20, 2006 (TW) ..... 95102309 A

(51) Int. Cl.
*H01H 1/10* (2006.01)

(52) U.S. Cl. ..... 200/512; 200/517

(58) Field of Classification Search ..... 200/310–314, 200/341–345, 510–520
See application file for complete search history.

(56) References Cited

U.S. PATENT DOCUMENTS 4,317,011 A * 2/1982 Mazurk ..... 200/5 A
4,484,039 A * 11/1984 Salie ..... 200/5 A
4,493,952 A * 1/1985 Kaleida ..... 200/5 A
4,496,812 A * 1/1985 Carley et al. ..... 200/512
4,639,559 A * 1/1987 Taguchi ..... 200/5 A
4,683,360 A * 7/1987 Maser ..... 200/314
5,149,923 A * 9/1992 Demeo ..... 200/5 A
5,595,288 A * 1/1997 Matsui et al. ..... 200/513
6,320,147 B1 * 11/2001 Simpson ..... 200/512
6,344,623 B1 * 2/2002 Yamazaki et al. ..... 200/512
6,423,171 B1 * 7/2002 Yang ..... 156/245
6,433,292 B1 * 8/2002 Tate ..... 200/512
6,552,289 B2 * 4/2003 Kawaguchi et al. ..... 200/512
6,617,536 B2 * 9/2003 Kawaguchi ..... 200/516
7,307,231 B2 * 12/2007 Matsumoto et al. ..... 200/512

* cited by examiner

*Primary Examiner*—Michael A Friedhofer
*Assistant Examiner*—Lisa N Klaus
(74) *Attorney, Agent, or Firm*—Wei Te Chung

(57) ABSTRACT

An elastic sheet (5) comprises a first sheet (10) plated a metal film (11) on an upper surface thereof, a number of moveable contacts (20) attached on a lower surface of the first sheet (10), a second sheet (30) affixed on the lower surface of the first sheet (10) and defining a number of receptacle holes (31) corresponding to the moveable contacts (20). The second sheet (30) extends curved an extending portion (5) from a lateral side thereof and defines a recess (5) in the extending portion (5) thereof. A switch comprises the elastic sheet (5) and a circuit board (6). When the moveable contacts (20) engage with the fixed contacts, the elastic sheet (5) is affixed on the circuit board (6) by the adhesive on the second sheet (5), and then the first extending portion (5) connects to the circuit board (6) for contacting a ground end thereof.

11 Claims, 4 Drawing Sheets

SHEET AND SHEET SWITCH

BACKGROUND OF THE INVENTION

1. Field of the Invention

The present invention relates to an elastic sheet and a switch using the elastic sheet, and particularly to an elastic sheet and a switch using the elastic sheet applied in consumer electronic applications.

2. Description of the Prior Art

A conventional elastic sheet and a switch using the sheet are disclosed in FIGS.1-3. The elastic sheet comprises a first sheet 10' plated with a metal film 11', a plurality of curved moveable contacts 20' attached to a bottom surface of the first sheet contact 10', a second sheet 30' attached on a bottom surface of the first sheet 10' and defining a plurality of receptacle holes 31' for receiving the moveable contacts 20', a separator sheet 40' affixed on a bottom surface of the second sheet 30'. The second sheet 30' defines a plurality of connecting slot 32' connecting the adjacent receptacle holes 31' for air circulation. The first sheet 10', the second sheet 30' and the separator sheet 40' define respectively a first extending portion 12', a second extending portion 33' and a third extending portion 41', wherein the first extending portion 12' and the second extending portion 33' bend towards the second sheet 30'.

A switch using the elastic sheet 5' comprise the elastic sheet 5' and a circuit board 6'. In assembling, the separator sheet 40' is peeled from the bottom surface of the second sheet 30'. The elastic sheet 5' is attached to the circuit board 6' by an adhesive on the bottom surface of the second sheet 30'. The circuit board 6' defines a plurality of outer fixed contacts 61' and a central fixed contacts 62', wherein the outer fixed contacts 61' are defined on outside of the circuit and the central fixed contacts are defined on inside of the circuit. Each fringe portion of the moveable contact abuts against the first fixed contact and the center portion of the moveable contact is separated with the second fixed contact. Referring to FIG. 2, the first extending portion 12' and the second extending portion 33' bend along the line A-A, and then connect to the circuit board 6' far contacting a ground end 63' thereof, which can realize the discharge of static electricity.

However, the drawback of said elastic sheet 5' lies in: when the first sheet 10' and the second sheet 30' are bent toward the second sheet 30', since the first sheet 10' is disposed on the second sheet 30' the metal film 11' plated on the first sheet 10' generates a deformation, which is prone to be torn apart. If the metal film 11' is torn apart, the static conducting test can not be attained or the heat produced during the static test makes the metal film 11' split Hence, an improved elastic sheet and a switch using the elastic sheet are required to overcome the disadvantages of the prior art.

BRIEF SUMMARY OF THE INVENTION

An object of the present invention is to provide an elastic sheet and a switch using the elastic sheet able to prevent a metal film breaking, which can ensure the sheet to pass the better static conducting test.

An elastic sheet in according with the present invention comprises a first sheet defining a metal film on an upper surface, an adhesive on a lower surface thereof, a plurality of moveable contacts attached on the lower surface of the first sheet, a second sheet mounted on the lower surface of the first sheet and defining a plurality of holes for receiving the corresponding moveable contacts, and a separator sheet attached on a lower surface of the second sheet, wherein the first sheet, the second sheet and the separator sheet each define respectively a extending portion from lateral side thereof. The extending portion of the second sheet defines a recess and the second sheet defines a plurality of channels to connecting the adjacent holes and an adhesive on each the lower and upper surface thereof.

The switch using the sheet comprises the aforementioned sheet and a circuit board with the a plurality of fixed contacts. In assembly, the separator sheet is peeled off from the lower surface of the second sheet. When the moveable contacts engage with the fixed contacts, the elastic sheet is affixed on the circuit board by the adhesive of on the lower surface of the second sheet and the first sheet and the second sheet are bent along the A-A line, thereby the metal film of the upper surface of the first sheet abuts against the ground portion of the circuit board, which can conduct the static electricity thereof.

Relative to the present technology, the sheet and the switch using the sheet define a recess in the second sheet thereof. When the first sheet and the second sheet are bent, only the first sheet is bent along the recess direction, hence, the stretch degree of the metal sheet of the upper surface of the sheet can be decreased, which can prevent the metal film from breaking and ensure the elastic sheet to pass though the static electricity test.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 4:
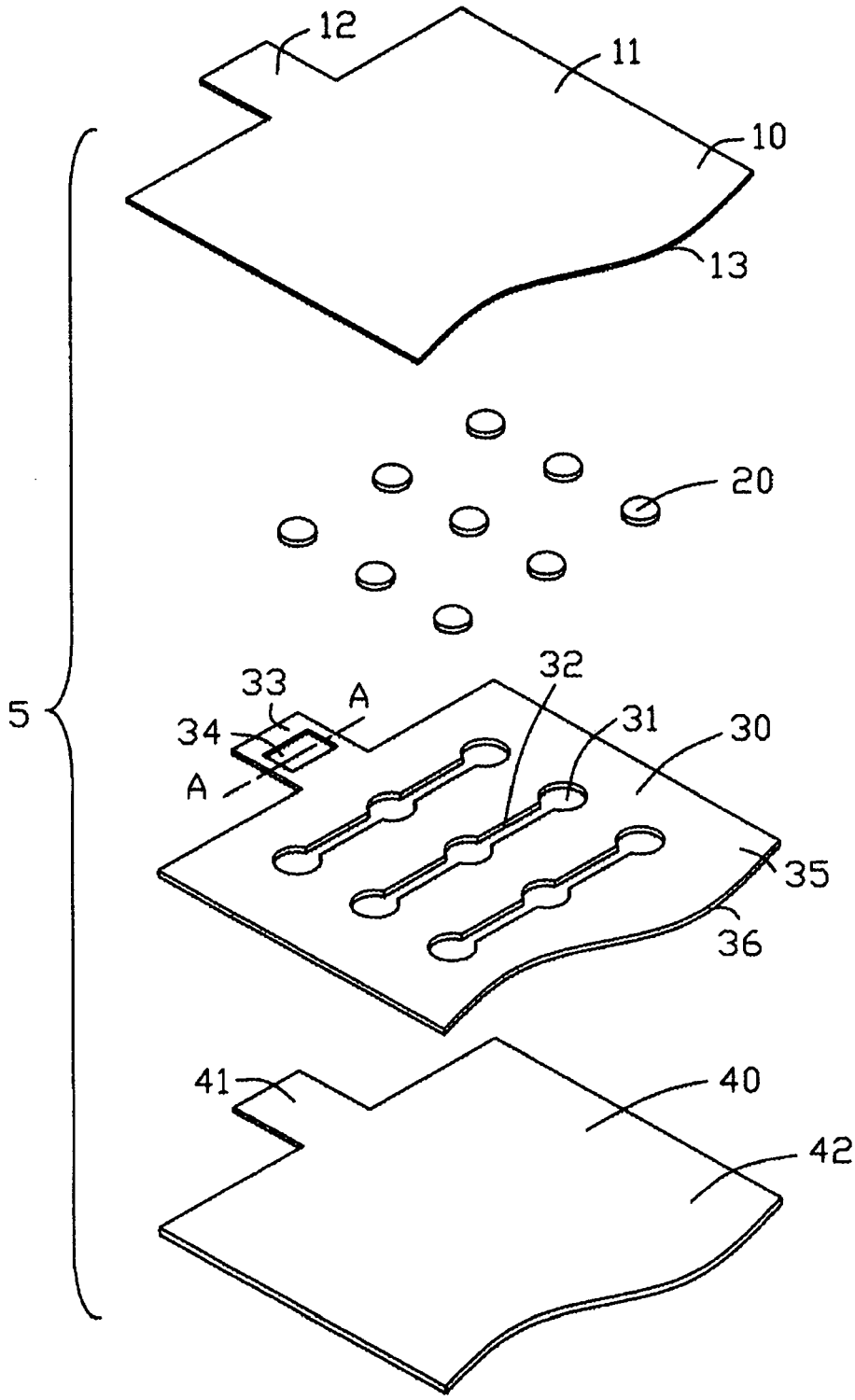
FIG. 4 is an exploded view of a sheet in accordance with a prefer embodiment of the invention.

Referring to FIG. 4, an elastic sheet 5 in accordance with a preferred embodiment of the present invention comprises a first sheet 10, a plurality of moveable contacts 20, a second sheet 30 and a separator sheet 40.

The first sheet 10 is made of insulative material and defines a metal film 11 on an upper surface thereof. The first sheet 10 defines a first extending portion 12 from a side thereof. Throughout the upper surface of the first extending portion 12 is applied an adhesive, however, other place of the upper surface of the first sheet 10 is applied a reticulation metal film and defines an adhesive 13 on a lower surface thereof.

The moveable contact 20 defines a central portion 21. The central portion 21 is affixed on the upper surface of the first sheet 10' by the adhesive.

The second sheet 30 is also made of the insulative material and defines a plurality of receptacle holes 31 corresponding of the moveable contacts 20, a number of connecting slots 32 for connecting the adjacent receptacle holes 20, and a second extending portion 33 extending from a lateral side thereof and disposing a rectangular recess 34. The second sheet 30 is applied adhesive on upper and lower surfaces thereof.

The separator sheet 40 defines a third extending portion 41 from a lateral side thereof and is applied an adhesive 42 on an upper surface thereof. The separator sheet 40 can prevent dust or the like from dropping into by the adhesive 42 affixed to a lower surface of the second sheet 40 and a lower surface of the moveable contact 20.

The first sheet 10, the second sheet 30 and the separator sheet cling with each other, and the first sheet 10 and the second sheet 30 can bend towards the second sheet 30.

Figure 1:
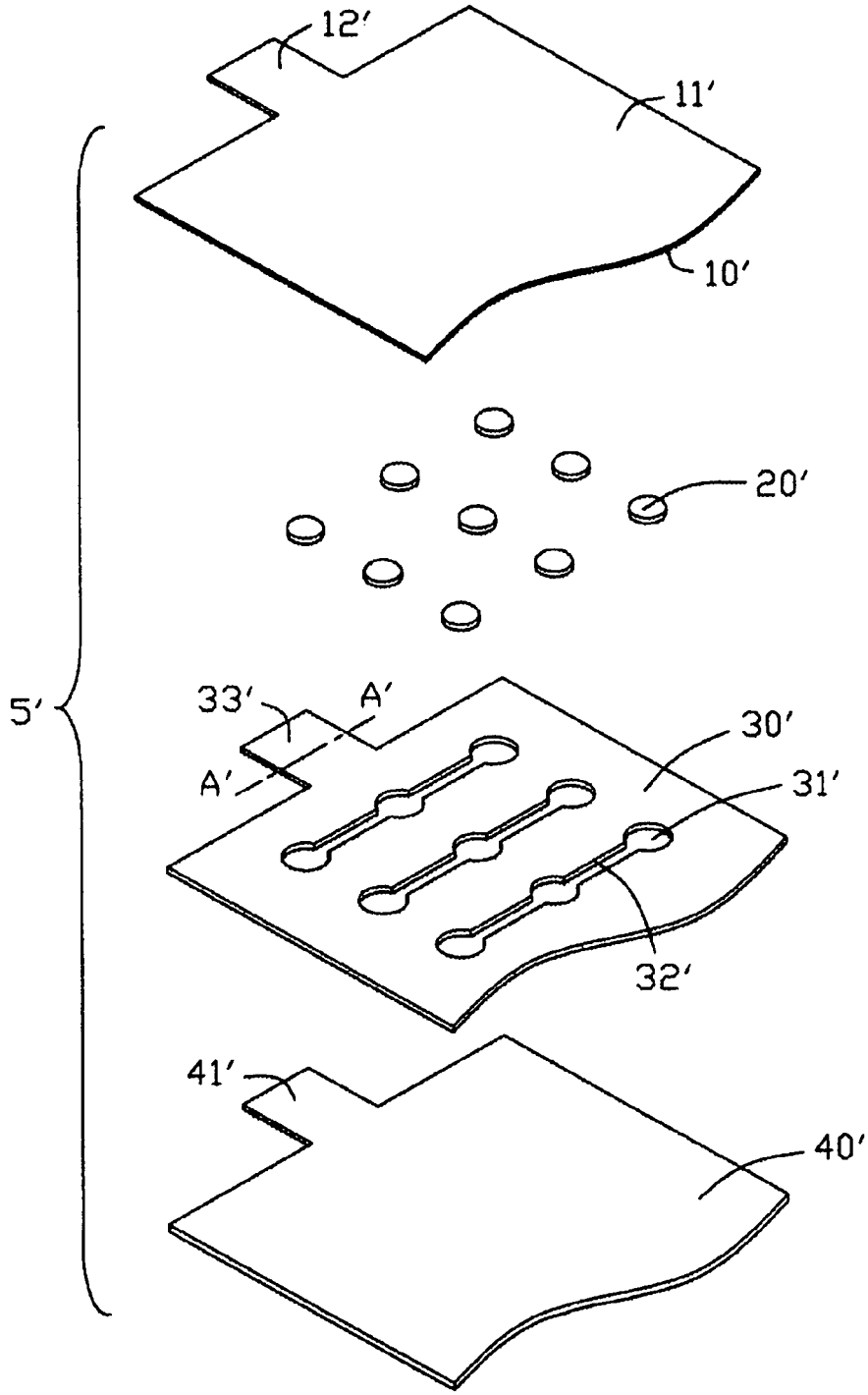
FIG. 1 PRIOR ART
FIG. 1 is an isometric view of a conventional sheet.
Figure 2:
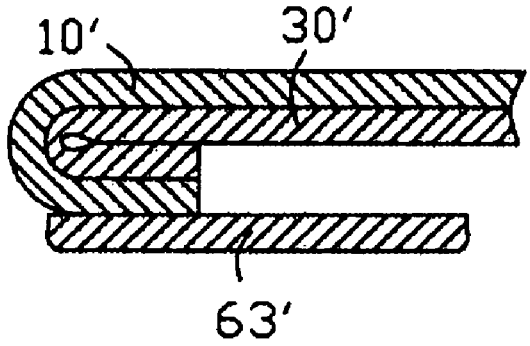
FIG. 2 PRIOR ART
FIG. 2 is a partially cross-sectional view of a extending portion bent along a line A -A of the sheet shown in FIG. 4.
Figure 3:
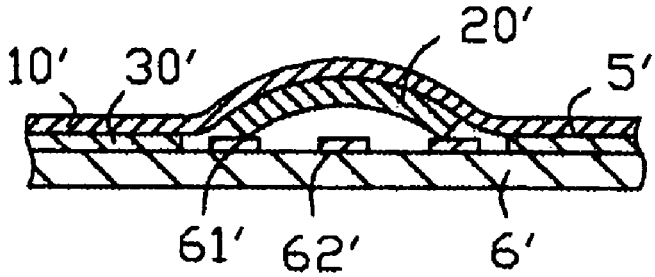
FIG. 3 PRIOR ART
FIG. 3 is a partially cross-sectional view of a switch using the sheet shown in FIG. 4.
Figure 5:
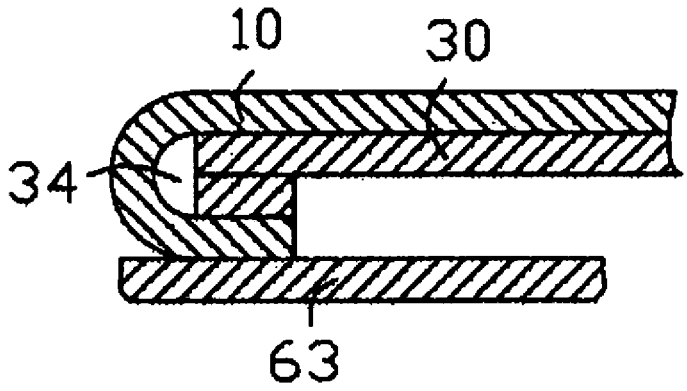
FIG. 5 is a partially cross-sectional view of a extending portion bent along a line A-A of the sheet shown in FIG. 4.
Figure 6:
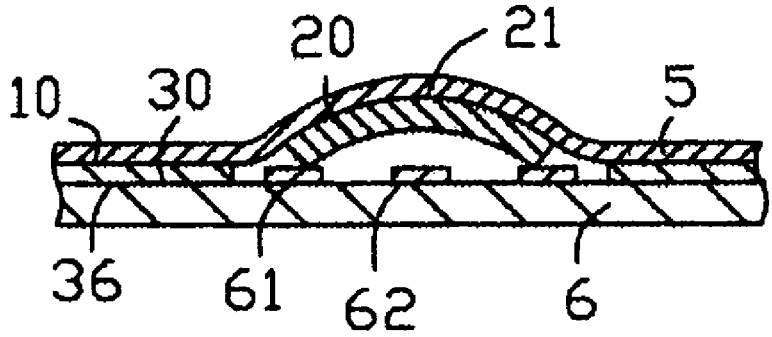
FIG. 6 is a partially cross-sectional view of a switch using the sheet.

Referring to the FIGS. 4-6, a switch using the elastic sheet 5 in accordance with the invention comprises the elastic sheet 5 and a circuit board 6. The switch is assembled in the following manner. The separator sheet 40 is peeled off from the elastic sheet 5, for example, by pulling it with hands. Thereafter, the elastic sheet 5 is positioned onto the circuit board 6, whose upper surfaces are affixed to the first sheet 10 and the movable contacts 20 are received in the receptacle holes 31. At this moment, the elastic sheet 5 is affixed onto the circuit board 6 through the adhesive applied to the lower surface of the second sheet 30 in such a manner that lower ends of outer peripheries of the movable contacts 20 are abutted against the outer fixed contacts 61 and that the central portions 21 of the movable contacts are separated with the central fixed contacts 62. Referring to FIG. 2 the first extending portion 12 and the second extending portion 31 bend along the line A-A and then connect to the circuit board 6 for contacting a ground end 63 thereof. Because the second sheet defines a recess on curved portion of the second extending portion, the thickness of the curved portion only has the thickness of the first sheet 10 in the length direction of the recess 34, which can decrease the extent of deformation of the metal film 11 during the metal film 11 being bent and ensure switch to pass through the static electricity test.

The operation of the sheet switch thus constructed will now be described. When an operating force is applied on the central portion 21 of the moveable contact 20, the associated movable contact 20 is depressed through the first sheet 10 and is inverted thereby, with the result that its central portion 21 comes into abutment against the associated central fixed contact 62, whereby the central fixed contact 62 is electrically connected with the associated outer fixed contact 61. In this position, air contained in the moveable contact 20 can circulate in the connecting slot 32 arranged on two sides of the receptacle holes 31. Upon release of the depressing force imposed on the push-button, the central portion 21 of the movable contact 20 is disconnected from the central fixed contact 62 with an elastic restoring force of the movable contact 20.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

What is claimed is:

1. An elastic sheet comprising:

a first sheet plated with a metal film on an upper surface thereof;

a number of moveable contacts attached on a lower surface of the first sheet;

a second sheet affixed on the lower surface of the first sheet and defining a number of receptacle holes corresponding to the moveable contacts; each of the first sheet and the second sheet having an extending portion respectively at a lateral side thereof and the extending portions bent towards the second sheet;

wherein the extending portion of the second sheet defines a recess.

2. The sheet as claimed in claim 1, wherein the recess is configured as rectangular shape and do not separate the second sheet into two parts.

3. The sheet as claimed in claim 1, wherein the recess separates the second sheet in two parts.

4. The sheet as claimed in claim 2, wherein the first sheet is affixed on the metal film on the upper surface of the extending portion thereof, and other portions of the upper surface of the first sheet is affixed with a reticulation metal film.

5. The sheet as claimed in claim 4, wherein the sheet defines a number of connecting slots for connecting adjacent receptacle holes.

6. The sheet as claimed in claim 1, wherein the second sheet is applied an adhesive on upper and lower surfaces thereof.

7. The sheet as claimed in claim 6, wherein the second sheet is affixed on a separator on the lower surface thereof before being assembled.

8. The sheet as claimed in claim 7, further comprising a cover mounted on the housing.

9. A switch comprising the sheet claimed in claim 1 and a circuit board, wherein when the moveable contacts engage with the fixed contact, the elastic sheet is affixed on the circuit board by the adhesive on the second sheet, and then the first extending portion connects to the circuit board for contacting a ground end thereof.

10. An elastic sheet assembly comprising:

a first sheet plated defining opposite upper and under surfaces;

a number of moveable contacts attached on the under surface of the first sheet;

a second sheet affixed on the under surface of the first sheet and defining a number of receptacle holes corresponding to the moveable contacts; each of the first sheet and the second sheet having an extending portion respectively at thereof a lateral side which is essentially located on a longitudinal end, and the extending portions folded back to have the extending portion of the second sheet essentially enclosed in that of the first sheet; wherein taken along a line of said extending portions of the first sheet and the second sheet in a longitudinal direction of said first sheet and the second sheet, a space is formed between the folded extending portion of the first sheet and that of the second sheet in said longitudinal direction.

11. The elastic sheet assembly as claimed in claim 10, wherein the folded extension portion of the first sheet is directly mounted upon a printed circuit board on which fixed contacts are seated corresponding to the moveable contacts.

* * * * *